US009106040B2

(12) United States Patent
Morikawa

(10) Patent No.: US 9,106,040 B2
(45) Date of Patent: Aug. 11, 2015

(54) DIE ASSEMBLY AND CRIMPING METHOD

(75) Inventor: Taishi Morikawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 95 days.

(21) Appl. No.: 13/808,623

(22) PCT Filed: Jul. 14, 2011

(86) PCT No.: PCT/JP2011/066083

§ 371 (c)(1),
(2), (4) Date: Jan. 7, 2013

(87) PCT Pub. No.: WO2012/008524

PCT Pub. Date: Jan. 19, 2012

(65) Prior Publication Data

US 2013/0104392 A1 May 2, 2013

(30) Foreign Application Priority Data

Jul. 15, 2010 (JP) ..... 2010-160694

(51) Int. Cl.

| | |
|---|---|
| ***H01R 4/18*** | (2006.01) |
| ***H01R 43/048*** | (2006.01) |
| ***H01R 43/058*** | (2006.01) |
| ***H01R 43/28*** | (2006.01) |

(Continued)

(52) U.S. Cl.

CPC ..... *H01R 43/058* (2013.01); *B21D 39/048* (2013.01); *H01R 4/184* (2013.01); *H01R 43/048* (2013.01); *H01R 43/28* (2013.01); *H01R 43/0482* (2013.01); *H01R 43/055* (2013.01); *Y10T 29/53235* (2015.01)

(58) Field of Classification Search

CPC ..... H01R 43/058; H01R 4/184; H01R 4/185; Y10T 29/53235

See application file for complete search history.

(56) References Cited

U.S. PATENT DOCUMENTS

| | | | | |
|---|---|---|---|---|
| 2,818,632 | A * | 1/1958 | Hammell | 29/865 |
| 6,176,731 | B1 | 1/2001 | Aoyama et al. | |
| 2008/0172864 | A1 | 7/2008 | Yagi et al. | |

FOREIGN PATENT DOCUMENTS

| | | | |
|---|---|---|---|
| CN | 1211090 | A | 3/1999 |
| CN | 101227056 | A | 7/2008 |

(Continued)

OTHER PUBLICATIONS

International Search Report (PCT/ISA/210) dated Aug. 16, 2011 issued by the International Searching Authority in counterpart International Application No. PCT/JP2011/066083.

(Continued)

*Primary Examiner* — Livius R Cazan

(74) *Attorney, Agent, or Firm* — Sughrue Mion, PLLC

(57) ABSTRACT

In the invention, an upper die (18) includes an anti-extrusion projection (17) that projects toward a signal conductor (14) placed on an upper side of a terminal forming piece (12) loaded on a lower die (19) and a die inner wall surface (18*a*) that situated on either side of the anti-extrusion projection (17) and that folds the terminal forming piece (12). When the terminal forming piece (12) is crimped to the signal conductor (14) by means of the upper die (18) and the lower die (19), the anti-extrusion projection (17) presses the signal conductor (14) downward, and the die inner wall surfaces (18*a*) fold the terminal forming piece (12) such that both ends of the terminal forming piece (12) come close to the anti-extrusion projection (17).

5 Claims, 6 Drawing Sheets

(51) Int. Cl.
*B21D 39/04* (2006.01)
*H01R 43/055* (2006.01)

(56) References Cited

FOREIGN PATENT DOCUMENTS

| | | | |
|---|---|---|---|
| JP | 180784 | U | 5/1989 |
| JP | 714658 | A | 1/1995 |
| JP | 750191 | A | 2/1995 |
| JP | 2006147223 | A | 6/2006 |

OTHER PUBLICATIONS

Written Opinion (PCT/ISA/237) of the International Searching Authority dated Aug. 16, 2011 in counterpart International Application No. PCT/JP2011/066083.
Chinese Office Action issued Aug. 28, 2014 by the State Intellectual Property Office of the People's Republic of China in counterpart Chinese Application No. 201180034856.5.

* cited by examiner

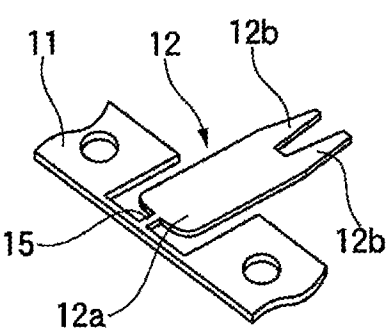
Fig.3(a)
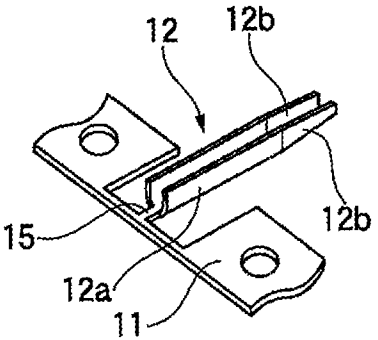
Fig.3(b)
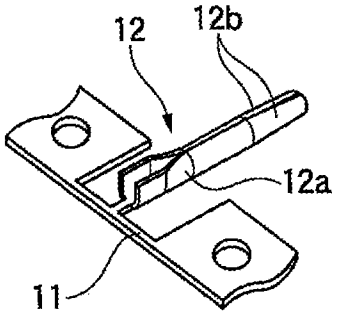
Fig.3(c)
Fig.3(d)
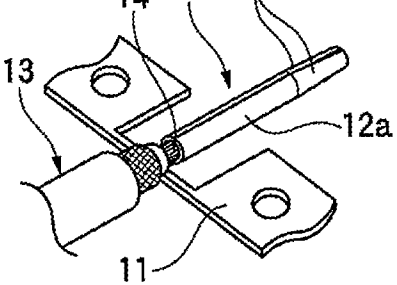
Fig.3(e)
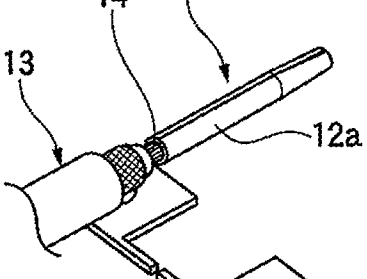
Fig.3(f)

DIE ASSEMBLY AND CRIMPING METHOD

TECHNICAL FIELD

The present invention relates to a die assembly for crimping a terminal to an electric wire having a signal conductor, like a coaxial cable, and a crimping method using the die assembly.

BACKGROUND ART

In an existing shielded wire terminal connection structure disclosed in Patent Document 1, a signal conductor connected to an inner conductor terminal is covered with a shielded conductor by way of an insulating inner sheath, and an outer conductor terminal is connected to a terminal of a shielded electric wire in which an outer periphery of the shielded conductor is covered with an insulating outer sheath.

The existing shielded wire terminal connection structure has a wire barrel made up of a pair of crimping pieces used for crimping an exposed shielded wire (a conductor) of the shielded wire terminal to an external conductor terminal by means of nipping. Processes for crimping a shielded wire by means of the crimping pieces of the wire barrel are as follows.

First, as shown in FIG. 6(*a*), a crimper 40 is placed above a wire barrel 26 loaded with a shielded wire 10, and an anvil 42 is situated below the wire barrel 26. During crimping work, the crimper 40 for use with a wire barrel is lowered from the position above the wire barrel 26 loaded with the shielded wire 10. Thereupon, a left-side crimping piece 30*b* in the drawing first contacts a die internal wall surface 76 that is a shallower pocket of the crimper 40, commencing to become curved inwardly along the die inner wall surface 76. The crimper 40 goes on to descend further, whereupon a right-side crimping piece 30*a* contacts a die inner wall surface 80 that is a deeper pocket of the crimper 40. The crimping piece 30*a* also commences to become curved inwardly along the die inner wall surface 80 in the same manner as does the left-side crimping piece 30*b*.

The wire barrel 26 loaded with the shielded wire 10 is then nipped between the anvil 42 situated below the wire barrel 26 and the crimper 40. As shown in FIG. 6(*b*), extremities of the respective crimping pieces 30*a* and 30*b* get to a protrusion 78 near a center axis of the crimper 40, thereby enwrapping the shielded wire 10.

As shown in FIG. 6(*c*), the extremity of the left-side crimping piece 30*b* of the wire barrel 26 first commenced to become curved is guided downwards by the protrusion 78 situated near the center of the crimper 40. Furthermore, the extremity of the right-side crimping piece 30*a* later commenced to become curved bends so as to lie on the left-side crimping piece 30*b*. The crimper 40 further goes on to descend, whereupon the extremities of the crimping pieces 30*a* and 30*b* reached the protrusion 78 near the center of the crimper 40 goes on to further experience flexion without involvement of a collision.

In relation to the wire barrel 26, the crimping piece 30*b* bent along the die inner wall surface 76 with a shallow pocket in the crimper 40 gets into a position below the crimping piece 30*a* on the other side, whereby the extremity of the right-side crimping piece 30*a* of the drawing is nipped and held down between the extremity of the crimping piece 30*b* bent from the left and the protrusion 78 of the crimper 40, as shown in FIG. 6(*c*) and FIG. 6(*d*). The extremity of the crimping piece 30*a* is at this time held down in a direction designated by arrow 62 shown in FIG. 6(*b*).

The crimper 40 further goes on to descend, and the extremity of the left-side crimping piece 30*b* gets into a position below the right-side crimping piece 30*a* in correction with the wire barrel 26, as shown in FIG. 6(*d*). Thus, the extremity of the right-side crimping piece 30*a* uniformly comes to lie over the left-side crimping piece 30*b* from the right and left sides. Finally, as shown in FIG. 6(*e*), the crimping pieces are bent evenly to both sides. Thus, it is possible to achieve the shielded wire terminal connection structure in a superior crimp state free from a misalignment between the center of the shielded wire and the signal conductor.

RELATED ART DOCUMENT

Patent Document

Patent Document 1: JP-A-2006-147223

DISCLOSURE OF THE INVENTION

Problem that the Invention is to Solve

The existing shielded wire terminal connection structure encounters the following problems to be solved.

Specifically, the shielded wire 10 does not stay at a normal swaging position on the wire barrel 26 because of vibrations, or the like, stemming from descending action of the crimper 40 as illustrated in FIG. 6(*a*). Hence, a gap H, such as that shown in FIG. 7(*a*), arises between the shielded wire 10 and the wire barrel 26. In this case, when the extremities of the crimping pieces 30*a* and 30*b* of the wire barrel 26 commence to interfere with (contact) the die inner wall surfaces 76 and 80 as shown in FIG. 7(*a*), a bottom (an indentation) of the wire barrel 26 cannot contact the shielded wire 10. For this reason, the wire barrel 26 is bent at its center, which corresponds to the bottom of the wire barrel, so as to become curved freely. A curvature of the bent becomes extremely small. Accordingly, if the crimper 40 further goes on to descend in this state as mentioned previously, a portion (an upper portion) of the shielded wire 10 will be nipped, while remaining extruded, between the crimping pieces 30*a* and 30*b* as shown in FIG. 7(*b*) when the respective crimping pieces 30*a* and 30*b* enwrap the shielded wire 10 while spaced apart from each other at the interval H. As a consequence, the shielded wire 10 is incompletely held by the wire barrel 26, which yields a disadvantage of the shielded wire 10 getting out of the wire barrel 26. A similar problem arises between a signal conductor made up of a plurality of core wires and a terminal crimped and held on the signal conductor.

The present invention has been conceived in light of the circumstance and aims at providing a die assembly and a crimping method that prevent extrusion of a signal conductor from space between both ends of terminal forming pieces, which would otherwise occur when the signal conductor of an electric wire placed on the terminal forming pieces is swaged so as to be enwrapped.

Means for Solving the Problem

To accomplish the objective, a die assembly of the invention is characterized by (1) and (2) described below.

(1) A die assembly having an upper die and a lower die for crimping a terminal forming piece of a chained terminal, which has a carrier and the flat-plate-like terminal forming pieces continually provided at multiple locations on the carrier in its longitudinal direction, to a signal conductor exposed at a portion of an electric wire, wherein the upper die has an anti-extrusion projection that projects toward the signal conductor placed on an upper side of the terminal forming piece loaded on the lower die and a die inner wall surface that is situated on either side of the anti-extrusion projection and that folds the terminal forming piece; and when the terminal forming piece is crimped to the signal conductor by means of the upper die and the lower die, the terminal forming piece is folded such that the anti-extrusion projection presses the signal conductor downward, and the die inner wall surfaces fold the terminal forming piece such that both ends of the terminal forming piece come close to the anti-extrusion projection.

(2) In the die assembly defined in (1), the die inner wall surfaces are formed in a tapered manner that is opened wider with a distance from the anti-extrusion projection increased.

In the die assembly having the configuration defined in (1) or (2), the anti-extrusion projection can prevent extrusion of the signal conductor from clearance between both ends of the terminal forming piece.

A crimping method of the invention is characterized by (3) provided below.

(3) A crimping method for crimping a terminal forming piece of a chained terminal, which has a carrier and the flat-plate-like terminal forming pieces continually provided at multiple locations on the carrier in its longitudinal direction, to a signal conductor exposed at a portion of an electric wire, wherein an anti-extrusion projection that is formed on an upper die of a first die assembly and that projects toward the signal conductor placed on an upper side of the terminal forming piece loaded on a lower die of the first die assembly presses the signal conductor downward, and a die inner wall surface that is situated on either side of the anti-extrusion projection and that folds the terminal forming piece folds the terminal forming piece such that both ends of the terminal forming piece come close to the anti-extrusion projection; and wherein the terminal forming piece is folded by means of a second die assembly such that both ends of the terminal forming piece come close to each other.

Under the crimping method having the configuration described in connection with (3), the anti-extrusion projection can prevent extrusion of the signal conductor from clearance between both ends of the terminal forming piece.

Advantage of the Invention

The invention makes it possible to prevent extrusion of a signal conductor from space between both ends of terminal forming pieces, which would otherwise occur when the signal conductor of an electric wire placed on the terminal forming pieces is swaged so as to be enwrapped.

The invention has been briefly described thus far. Further, details of the invention will be further clarified by reading through an embodiment for implementing the invention, which will be described below, by reference to the accompanying drawings.

BRIEF DESCRIPTION OF THE DRAWINGS

FIG. 3(*a*) to FIG. 3(*f*) are explanatory views showing steps of processing the chained terminal of the embodiment of the invention, in which FIG. 3(*a*) to FIG. 3(*f*) are views showing the steps.

EMBODIMENT FOR IMPLEMENTING THE INVENTION

A crimping method of an embodiment of the invention is hereunder described by reference to FIG. 1 to FIG. 5(*b*).

Figure 1:
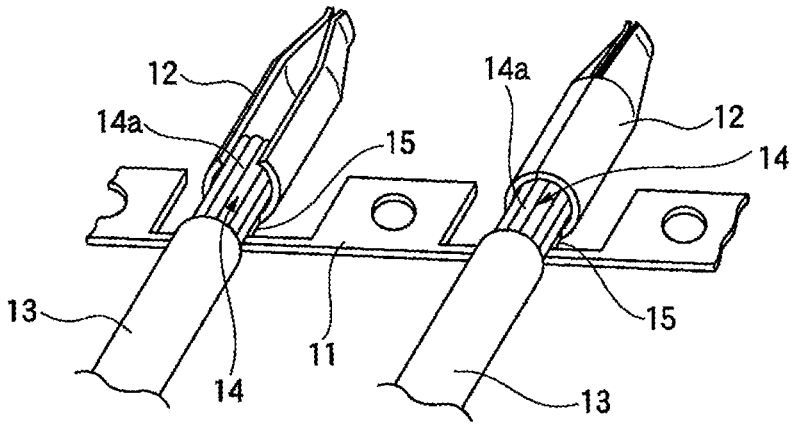
FIG. 1 is a perspective view showing a step of processing a chained terminal of an embodiment of the invention.

A chained terminal of the embodiment shown in FIG. 1 includes a carrier 11 and flat-plate-like terminal forming pieces 12 continually provided at multiple locations on the carrier 11 in its longitudinal direction. The terminal forming pieces 12 are formed as terminals by means of pressing. An extremity of a signal conductor 14 of an electric wire 13 is accommodated in each of the terminal forming pieces 12 folded during pressing work. The terminal forming pieces 12 are continually provided, by way of respective carrier bridges 15, at the multiple locations on the carrier 11 in its longitudinal direction.

The signal conductor 14 is made by bundling a plurality of core wires 14*a*. The extremity of the signal conductor 14 is loaded at a center of each of the terminal forming pieces 12. Right and left ends of the terminal forming piece 12 are folded toward the signal conductor 14 at the load position, whereby the signal conductor 14 is swaged by the terminal forming piece 12.

Figure 2:
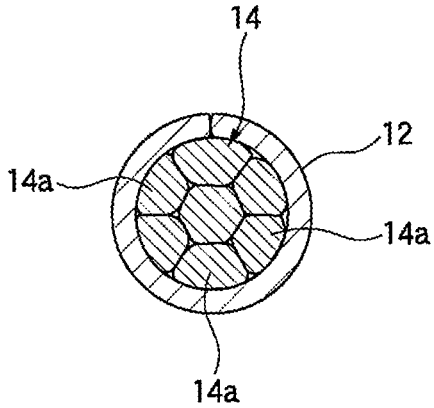
FIG. 2 is a cross sectional view showing an electric wire shown in FIG. 1 swaged with terminal forming pieces.

In this case, before both ends of the terminal forming piece 12 are completely closed; namely, before the respective ends of the terminal forming piece 12 contact each other, the core wires 14*a* of the signal conductor 14 are pressed with substantially no space therebetween by means of an anti-extrusion projection (which will be described later) of a mold assembly inserted between the ends. Both ends of the terminal forming piece 12 are swaged to the signal conductor 14 whose core wires 14*a* are pressed, whereby the signal conductor 14 is held in the folded terminal forming piece 12 without involvement of extrusion from clearance between both ends as shown in FIG. 2. FIG. 2 illustrates a case where the signal conductor 14 includes seven core wires 14*a*. However, the invention is not limited to this number. Even in the case of one core wire, the invention is applicable.

Processes of formation of the chained terminal of the embodiment of the invention are described in conjunction with changes in configuration of the terminal by reference to FIG. 3(*a*) to FIG. 3(*f*). FIG. 3(*a*) to FIG. 3(*f*) are views for explaining a round of processes through which the chained terminal of the embodiment of the invention is pressed.

First, a flat metal plate is put on and pressed by a first press-cutting die block, thereby forming, as shown in FIG. 3(*a*), the strip-shaped carrier 11 and the rectangular terminal forming piece 12 continually provided at one end of the carrier 11 extended in its longitudinal direction. The terminal forming piece 12 is made up of a terminal forming piece body 12*a* that will enwrap the signal conductor 14 of the electric wire 13 by means of pressing, which will be described later, to thus be electrically connected to the signal conductor; a carrier bridge 15 that connects the terminal forming piece body 12*a* to the carrier 11; and a pair of contacts 12*b* extended from one end of the terminal forming piece body 12*a* opposite to the carrier 11. The contacts 12*b* taper down toward their extremities, to thus assume a truncated conical shape by means of swaging work to be described later. The contacts 12*b* form an extremity of the terminal (areas that contact its counterpart terminal) when the terminal forming piece 12 has turned into a terminal. In the terminal forming piece 12 continually provided on the carrier 11 by way of the carrier bridge 15, the area of the terminal forming piece 12 close to the contact 12*b* is referred to as a leading end side, and the area of the terminal forming piece 12 close to the carrier 11 is referred to as a rear end side.

Subsequently, the terminal forming piece 12 press-cut by the first press-cutting die block is placed on a second pressing die block, to thus be pressed. In FIG. 3(*b*), in relation to the terminal forming piece 12, both sides of the terminal forming piece body 12*a* with the carrier bridge 15 sandwiched therebetween and the two contacts 12*b* are folded to the center of the terminal forming piece body 12*a* continually connected to the carrier bridge 15. Provided that the center of the terminal forming piece body 12*a* is taken as a bottom side, a cross section profile of the terminal forming piece 12 achieved at this time is formed into a substantially-U-shaped configuration, where both sides of the terminal forming piece body 12*a* stand upright from both ends of the center.

The terminal forming piece 12 pressed by the second die block is placed on a third pressing die block and further subjected to pressing work. In FIG. 3(*c*), in relation to the terminal forming piece 12, a substantially one-half of the leading end side of the terminal forming piece body 12*a* is closed. Specifically, the terminal forming piece body 12*a* is pressed in such a way that leading-end-side substantial halves of both ends of the terminal forming piece body 12*a* come close to each other. In the meantime, a rear-end-side substantial half of the terminal forming piece body 12*a* is opened upward as illustrated in FIG. 3(*b*); in other words, both sides of the terminal forming piece body 12*a* stand upright from both ends of the center of the terminal forming piece body 12*a*, to thus make up a substantially-U-shaped configuration.

In FIG. 3(*d*), the signal conductor 14 that is exposed at one end of the electric wire 13 is placed on the rear end of the terminal forming piece body 12*a*. Since a substantially one-half of the rear end side of the terminal forming piece body 12*a* remains opened upward, the signal conductor 14 can be placed at the center of the terminal forming piece body 12*a*.

Subsequently, the terminal forming piece body is subjected to press-work by means of a third die block, whereupon the terminal forming piece 12 whose terminal forming piece body 12*a* is loaded with the signal conductor 14 is placed on a fourth pressing die block, to thus further experience press work. As shown in FIG. 3(*e*), in relation to the terminal forming piece 12, a substantially one-half of the rear end side of the terminal forming piece body 12*a* where the signal conductor 14 of the electric wire 13 is placed is closed. Specifically, the terminal forming piece body 12*a* is formed in such a way that rear-end-side substantial halves of both sides of the terminal forming piece body 12*a* come close to each other.

The terminal forming piece 12 goes through the processes shown in FIGS. 3(*a*) to 3(*e*), whereby the signal conductor 14 of the electric wire 13 is connected to the terminal forming piece body 12*a* and concurrently formed into a configuration of a terminal. Subsequently, the terminal forming piece 12 pressed by the fourth die block is placed on a fifth press-cutting die block. As shown in FIG. 3(*f*), areas of the carrier 11 that are on both sides of the carrier bridge 15 are cut. Thus, a terminal 16 connected to the signal conductor 14 of the electric wire 13 is formed.

The chained terminal of the embodiment of the invention can be formed through a step of pressing the terminal forming piece 12 into the configuration of a terminal and a step of connecting the terminal to the signal conductor 14 of the electric wire 13 by means of a round of press work operations. Specifically, when compared with the related art, there is no necessity for taking a pressed terminal out of a die assembly and placing the terminal on a terminal crimping apparatus equipped with an anvil and a crimper. For this reason, an attempt can be made to enhance efficiency of work for producing an electric wire equipped with a terminal.

Incidentally, in the step shown in FIG. 3(*d*), the signal conductor 14 that is exposed from one end of the electric wire 13 is placed in an U-shaped area at the center of the terminal forming piece body 12*a* whose both ends stand upright. Subsequently, as shown in FIG. 3(*e*), both ends of the center of the terminal forming piece body 12*a* are closed. In the course of both ends being closed, an anti-extrusion projection provided in the die assembly (the fourth die block) is inserted between the ends. When the anti-extrusion projection is inserted between both ends, the anti-extrusion projection presses down the core wires 14*a* of the signal conductor 14 from above. Thereby, the core wires 14*a* compactly overlap each other, thereby diminishing an outer diameter of the overall signal conductor 14. Further, the signal conductor 14 comes into close contact with an upper U-shaped interior of the terminal forming piece body 12*a*. Detailed descriptions are hereinbelow provided for press work of the processes.

Figure 4A:
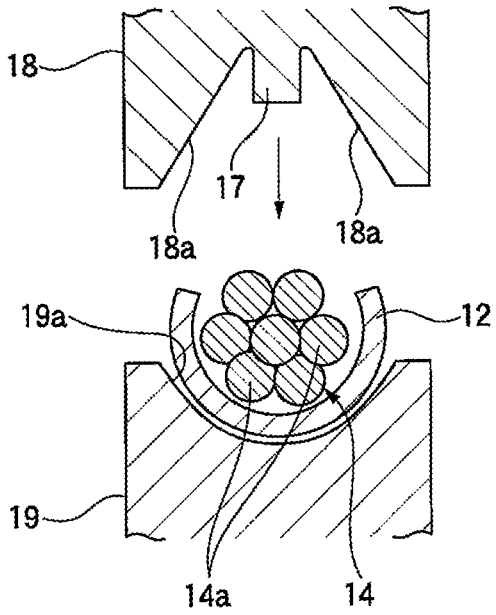
FIG. 4(*a*) and FIG. 4(*b*) are explanatory views showing a swaging step of swaging the electric wire with the terminal forming pieces in connection with FIG. 3(*e*), in which FIG. 4(*a*) is a view showing the chained terminal achieved before swaging and FIG. 4(*b*) is a view showing the chained terminal achieved after swaging.
Figure 4B:
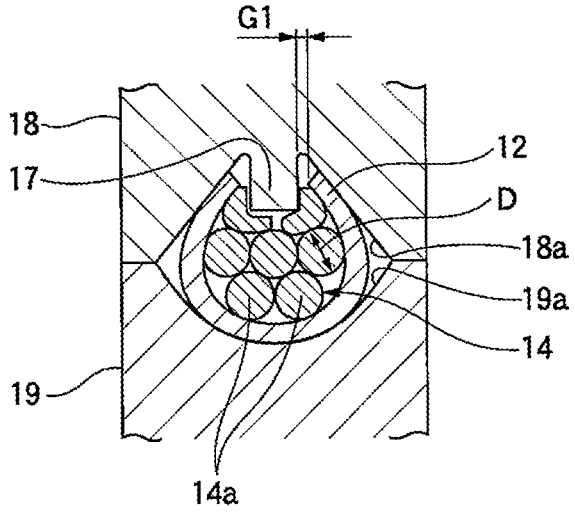

FIG. 4(*a*) and FIG. 4(*b*) show processes for swaging the terminal forming piece body made up of an upper die 18 having an anti-extrusion projection 17 and a lower die 19 for supporting the terminal forming piece body 12*a* pressed into the letter U. The upper die 18 has on its lower side a pair of die inner wall surfaces 18*a* that form a downwardly-opened, V-shaped trench. A depth and width of the V-shaped trench forming the die inner wall surfaces 18*a* are previously set in accordance with a size of the terminal forming piece body 12*a* that is an object of swaging, a cross-sectional area of the signal conductor 14, and others. An angle that the V-shaped, mutually-opposed die inner wall surfaces 18*a* form is set so as to fall within a range of 80 degrees to 100 degrees, preferably a range of 85 degrees to 95 degrees. The rectangular anti-extrusion projection 17 is projectingly provided in an area where the die inner wall surfaces 18*a* cross each other; namely, in a vicinity of a V-shaped bottom. Therefore, the die inner wall surface 18*a* is positioned on either side of the anti-extrusion projection 17.

The anti-extrusion projection 17 is a projection that is greater than a thickness of the terminal forming piece body 12*a* and that does not project downwards in excess of a lower end of the upper die 18. The anti-extrusion projection 17 projects toward the core wires 14*a* positioned on the terminal forming piece body 12*a* loaded on the lower die 19. The anti-extrusion projection 17 performs action so as to press the core wires 14*a* of the signal conductor 14 from above in the course of folding the terminal forming piece body 12*a* to thereby enwrap the signal conductor 14 positioned on the terminal forming piece body 12*a*.

In the meantime, the lower die 19 has, on its upper side opposing the V-shaped die inner wall surfaces 18*a* and 18*a*, a substantially semicircular die inner wall surface 19*a*. A size and a shape of the die inner wall surface 19*a* are also set so as to enable fixed swaging of the core wires 14*a* of the signal conductor 14 loaded on the terminal forming piece body 12*a* along with the die inner wall surfaces 18*a*. Accordingly, on an occasion when the signal conductor 14 exposed from the electric wire 13 is swaged to the U-shaped portion of the terminal forming piece body 12*a* so as to close the terminal forming piece body 12*a* as shown in FIG. 3(*d*), the U-shaped portion of the terminal forming piece body 12*a* is loaded on the semi-circular die inner wall surface 19*a* of the lower die 19, and the signal conductor 14 is set in the U-shaped portion as shown in FIG. 4(*a*).

The upper die 18 is now lowered (dropped), to thus let both ends of the terminal forming piece body 12*a* contact the V-shaped die inner wall surfaces 18*a* of the upper die 18. The upper die 18 is lowered further, both ends commence to start being folded in equal amount along the respective die inner wall surfaces 18*a*, thereby becoming bent toward the signal conductor 14. The signal conductor 14 thus comes into being enwrapped by the terminal forming piece body 12*a*, the anti-extrusion projection 17 passes through gap between both ends of the terminal forming piece body 12*a* with lowering action of the upper die 18, thereby pressing the signal conductor 14 in the U-shaped portion downwardly from above. A resultant state is like it is shown in FIG. 4(*b*), and the terminal forming piece body 12*a* is folded such that both ends of the terminal forming piece body 12*a* come close to the anti-extrusion projection 17. Gap G1 between the anti-extrusion projection 17 worked into the clearance between both ends of the terminal forming piece body 12*a* and both ends of the terminal forming piece body 12*a* is set preferably to an outer diameter D or less of the core wires 14*a* making up the signal conductor 14. It is thereby possible to reliably prevent the core wires 14*a* of the signal conductor 14 from escaping (extruding) outside from the interior of the terminal forming piece body 12*a* enwrapping the signal conductor 14 by way of gap G1.

Next, the terminal forming piece 12 swaging the signal conductor 14 as mentioned above is separated from the lower die 19 by elevating the upper die 18. The signal conductor 14 in the thus-separated terminal forming piece 12 has an indentation 14*b* formed as a result of some of the core wires 14*a* having been partially recessed in a rectangular shape, and the indentation faces the clearance between the ends of the terminal forming piece 12 which still remains open. Accordingly, a separate finishing die assembly 21, such as that shown in FIG. 5(*a*) and FIG. 5(*b*), is prepared, and the terminal forming piece 12 is subjected to swaging under stronger pressure by use of the die assembly 21 such that the terminal forming piece 12 assumes a substantially cylindrical cross section (press work performed by use of the finishing die assembly 21 is also included in the press work performed by use of the fourth die block shown in FIG. 3(*e*)). The die assembly 21 shown in FIG. 5(*a*) and FIG. 5(*b*) is made up of an upper die 22 and a lower die 23. A semicircular downwardly-oriented die inner wall surface 22*a* is formed in a lower side of the upper die 22. An upwardly-oriented die inner wall surface 23*a* that is the same in shape and size as the downwardly-oriented die inner wall surface 22*a* is formed in an upper side of the lower die 23. The downwardly-oriented die inner wall surface 22*a* and the upwardly-oriented die inner wall surface 23*a* are directed toward a position where both of the wall surfaces oppose each other along the vertical direction.

Figure 5A:
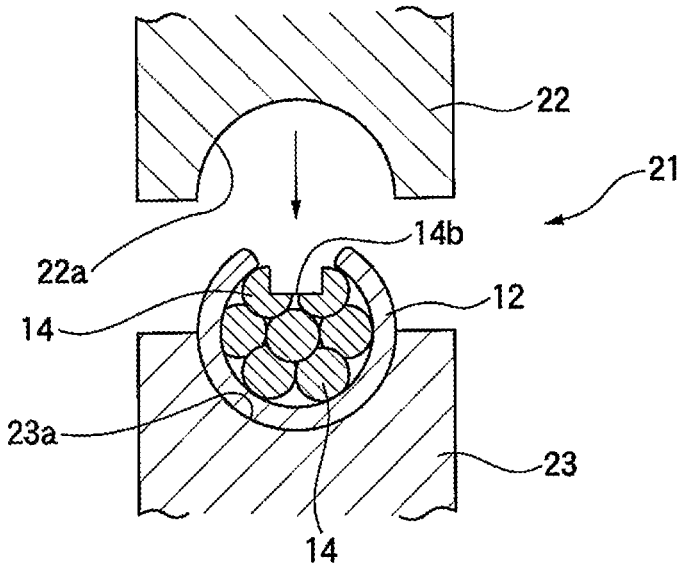
FIG. 5(*a*) and FIG. 5(*b*) are explanatory views showing finish swaging steps practiced subsequently to the swaging steps shown in FIG. 4(*a*) and FIG. 4(*b*), in which FIG. 5(*a*) is a view showing the chained terminal achieved before swaging and FIG. 5(*b*) is a view showing the chained terminal achieved after swaging.
Figure 5B:
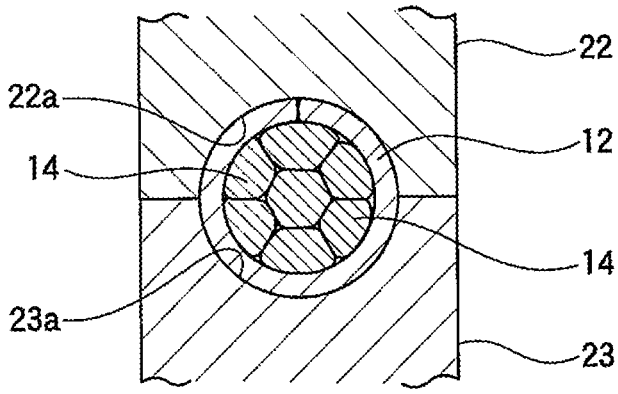
Figure 6A:
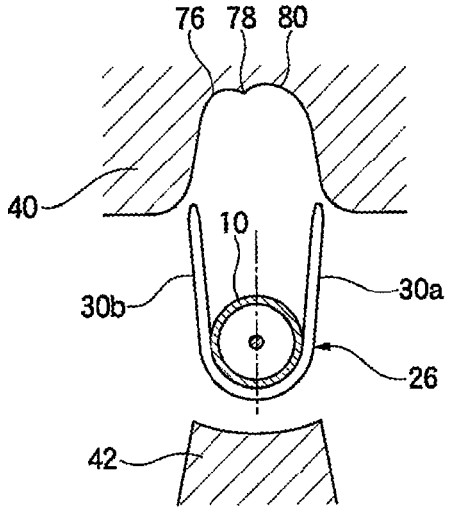
Fig.6(a) PRIOR ART
FIG. 6(*a*) to FIG. 6(*e*) are explanatory views showing existing steps of crimping a wire barrel of a shielded wire, in which FIG. 6(*a*) to FIG. 6(*e*) show the steps, respectively.
Figure 6B:
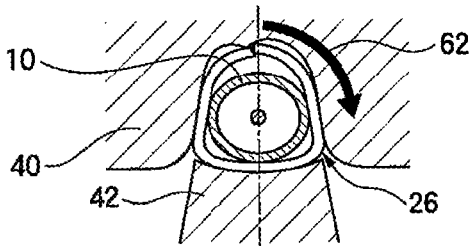
Fig.6(b) PRIOR ART
Figure 6C:
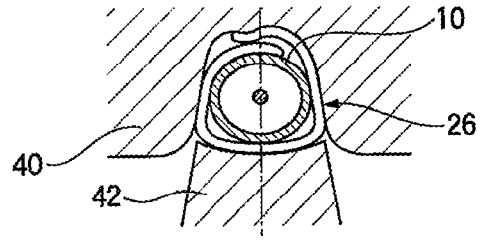
Fig.6(c) PRIOR ART
Figure 6D:
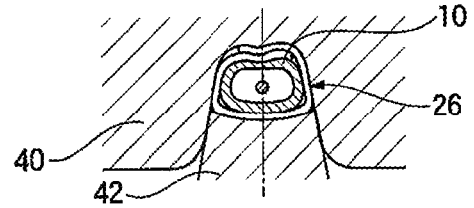
Fig.6(d) PRIOR ART
Figure 6E:
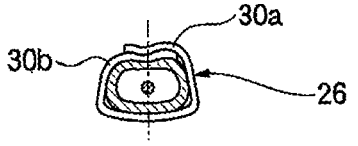
Fig.6(e) PRIOR ART
Figure 7A:
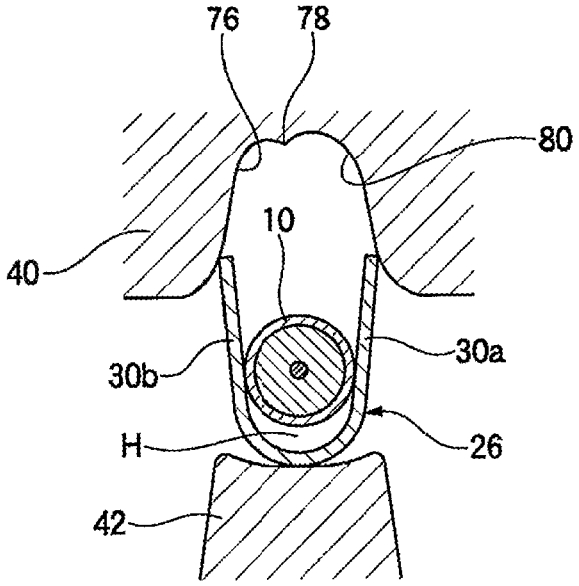
Fig.7(a) PRIOR ART
FIG. 7(*a*) and FIG. 7(*b*) are explanatory views showing existing processes of inappropriate deformed crimping of wire barrel, in which FIG. 7(*a*) and FIG. 7(*b*) are views showing the processes, respectively.
Figure 7B:
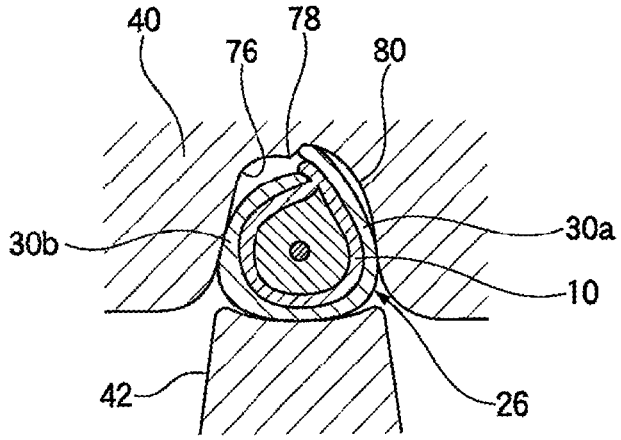
Fig.7(b) PRIOR ART

Consequently, the terminal forming piece 12 that has swaged the signal conductor 14 and that has been separated (removed) from the lower die 19 shown in FIG. 4(*a*) and FIG. 4(*b*) is placed on the upwardly-oriented die inner wall surface 23*a* of the lower die 23 as shown in FIG. 5(*a*). Subsequently, the upper die 22 is lowered, thereby pressing the terminal forming piece 12 toward the lower die 23 by means of the downwardly-oriented die inner wall surface 22*a*. The terminal forming piece body 12*a* is at this time folded such that both ends of the terminal forming piece body 12*a* come close to each other. Further, the terminal forming piece 12 is formed such that the cross sectional profile of the terminal forming piece 12 is formed into a substantially circular shape, such as that shown in FIG. 5(*b*), along the configuration of the downwardly-oriented die inner wall surface 22*a* and the upwardly-oriented die inner wall surface 23*a*.

The signal conductor 14 and the terminal forming piece 12 thus formed by means of the upper die 22 and the lower die 23 come to form a terminal that assumes a circular cross sectional profile as shown in FIG. 2 and in which the core wires 14*a* come into close contact with each other within the terminal forming piece 12, the core wires 14*a* and the terminal forming piece 12 remaining in electrical conduction. In such a terminal, the electric wire 13 does not extrude from the terminal forming piece 12 during swaging work, such as that mentioned above, and hence desired mechanical strength and electrical connection become feasible.

The present embodiment has provided descriptions about the case of preventing extrusion of the core wires 14*a* of the signal conductor 14 from the clearance between both ends of the terminal forming piece during swaging work. However, the invention can also be applied to a case of preventing a portion of a shielded wire from extruding out of clearance between both ends of a terminal forming piece when the shielded wire of a shielded cable is fixedly swaged by means of the terminal forming piece, such as a barrel.

As above, by means of the die assembly and the crimping method of the invention, the terminal forming piece 12 loaded with the signal conductor 14 is swaged so as to enwrap the signal conductor 14 while the signal conductor 14 is pressed, thereby reliably avoiding extrusion of the core wires 14*a* of the signal conductor 14 from the clearance between both ends of the terminal forming piece 12. As a consequence, it is possible to prevent the signal conductor from extruding from the clearance between both ends of the terminal forming piece, which would otherwise occur when the signal conductor of the electric wire loaded on the terminal forming piece is swaged so as to be enwrapped.

Although the invention has been described in detail by reference to the specific embodiment, it is manifest to those who are versed in the art that the invention be susceptible to various alterations or modifications without departing the spirit and scope of the invention.

The patent application is based on Japanese Patent Application (JP-2010-160694) filed on Jul. 15, 2010, the subject matter of which is incorporated herein by reference in its entirety.

INDUSTRIAL APPLICABILITY

The die assembly and the crimping method of the invention yield an advantage of the ability to prevent extrusion of a signal conductor from clearance between both ends of a terminal forming piece, which would otherwise occur when the signal conductor of an electric wire loaded on the terminal forming piece is swaged so as to be enwrapped.

DESCRIPTION OF THE REFERENCE NUMERALS AND SYMBOLS

11 CARRIER
12 TERMINAL FORMING PIECE
12*a* TERMINAL FORMING PIECE BODY
12*b* CONTACT
13 ELECTRIC WIRE
14 SIGNAL CONDUCTOR
15 CARRIER BRIDGE
16 TERMINAL
17 ANTI-EXTRUSION PROJECTION
18 UPPER DIE
18*a* DIE INNER WALL SURFACE
19 LOWER DIE
19*a* DIE INNER WALL SURFACE
G1, H GAP

The invention claimed is:

1. A die assembly, comprising:

an upper die and a lower die for crimping a terminal forming piece of a chained terminal to a signal conductor at a portion of an electric wire, the chained terminal having a carrier and the terminal forming pieces continually provided at multiple locations on the carrier in its longitudinal direction;

wherein the upper die includes:

a pushing means for pushing the signal conductor downward during crimping, the pushing means including an anti-extrusion projection projected toward the signal conductor placed on an upper side of the terminal forming piece loaded on the lower die; and die inner wall surfaces respectively situated on both sides of the anti-extrusion projection for folding the terminal forming piece, and wherein when the terminal forming piece is crimped to the signal conductor by the upper die and the lower die, the anti-extrusion projection contacts and presses the signal conductor downward, and the die inner wall surfaces fold the terminal forming piece such that both ends of the terminal forming piece approach the anti-extrusion projection, wherein the anti-extrusion projection is rectangular and is integral with the upper die, the anti-extrusion projection has a base end attached to the upper die and a distal end extended away from the base, and the width of the base end is substantially equivalent to the width of the distal end.

2. The die assembly according to claim 1, wherein the die inner wall surfaces are formed in a tapered manner so as to be opened wider with a distance from the anti-extrusion projection increased.

3. The die assembly according to claim 1, wherein the die inner wall surfaces and the anti-extrusion projection are configured to prevent the ends from contacting each other.

4. The die assembly according to claim 3, wherein the die inner wall surfaces are inclined in a v-shaped manner with the anti-extrusion projection disposed therebetween.

5. A crimping method for crimping a terminal forming piece of a chained terminal, which has a carrier and the flat-plate-like terminal forming pieces continually provided at multiple locations on the carrier in its longitudinal direction, to a signal conductor exposed at a portion of an electric wire, wherein an anti-extrusion projection formed on an upper die of a first die assembly and that projects toward the signal conductor placed on an upper side of the terminal forming piece loaded on a lower die of the first die assembly presses the signal conductor downward, and a die inner wall surface that is situated on either side of the anti-extrusion projection and that folds the terminal forming piece folds the terminal forming piece such that both ends of the terminal forming piece come close to the anti-extrusion projection; and wherein the terminal forming piece is folded by a second die assembly such that both ends of the terminal forming piece come close to each other.

* * * * *